United States Patent [19]

Tucker

[11] Patent Number: 4,793,110

[45] Date of Patent: Dec. 27, 1988

[54] FOUNDATION AND BUILDING STRUCTURE SUPPORT SYSTEM APPARATUS AND METHOD

[76] Inventor: Joe W. Tucker, 1915 Tipperary, Leander, Tex. 78641

[21] Appl. No.: 31,741

[22] Filed: Mar. 30, 1987

[51] Int. Cl.[4] ..... E04F 11/18

[52] U.S. Cl. ..... 52/297; 52/23; 52/126.6; 52/169.9; 52/DIG. 11; 248/188.4; 248/354.3; 248/357

[58] Field of Search ..... 52/169.9, 126.6, 23, 52/262, 295–297, DIG. 11, 148; 248/357, 352, 188.4, 354.3

[56] References Cited

U.S. PATENT DOCUMENTS

| | | | |
|---|---|---|---|
| 806,718 | 12/1905 | Wilson | 52/297 X |
| 1,553,785 | 9/1925 | Ley | 52/297 |
| 3,022,980 | 2/1962 | Barker . | |
| 3,380,205 | 4/1968 | Ratchford . | |
| 3,579,936 | 5/1971 | Andersson | 52/297 |
| 3,653,169 | 4/1972 | Jenner . | |
| 3,713,259 | 1/1973 | Tkach . | |
| 3,724,151 | 4/1973 | Kaywood et al. | 52/DIG. 11 |
| 3,744,192 | 7/1973 | Burnett | 52/DIG. 11 |
| 3,751,866 | 8/1973 | Renchen | 52/DIG. 11 |
| 3,793,787 | 2/1974 | Shidaker et al. | 52/DIG. 11 |
| 3,830,024 | 8/1974 | Warnke . | |
| 3,830,457 | 8/1974 | Stewart | 52/DIG. 11 |
| 3,857,575 | 12/1974 | Lee | 52/DIG. 11 |
| 4,125,975 | 11/1978 | Soble . | |
| 4,180,952 | 1/1980 | Vanderlyn | 52/148 |
| 4,546,581 | 10/1985 | Gustafson . | |

FOREIGN PATENT DOCUMENTS

| | | | |
|---|---|---|---|
| 2207463 | 8/1973 | Fed. Rep. of Germany | 52/297 |
| 571895 | 5/1924 | France | 52/297 |
| 705076 | 12/1979 | U.S.S.R. | 52/297 |

*Primary Examiner*—David A. Scherbel
*Assistant Examiner*—Richard E. Chilcot, Jr.
*Attorney, Agent, or Firm*—John N. Shaffer, Jr.

[57] ABSTRACT

Tubular columns of approximately rectangular cross section secured and supported at their lower ends by deformable sockets, pre-cast in concrete at grade level or floor level, and support a structure at their upper ends and/or along their length. The socket has three vertical sides and one sloping side, to receive the column and a wedge, which is driven to secure the column. All forces between the wedge, column, and socket are passed through the socket and retained by the concrete, so that bending loads upon the column are limited only by the bending strength of the column itself. Vertical movement of the column out of the socket is restricted by friction from the extreme pressure generated by the driven wedge upon the column, socket, and concrete. Height adjustment is provided by an alternate deep socket, in which case the column is further prevented from movement into the socket by a bolt and bracket which causes the driven wedge to move further toward the socket along with the column, increasing the supporting friction. Different size columns and wedges can be provided for a given socket, and columns can be installed after a mobile home or other underframe structure is rolled or otherwise moved into final position and lowered and levelled.

21 Claims, 5 Drawing Sheets

FOUNDATION AND BUILDING STRUCTURE SUPPORT SYSTEM APPARATUS AND METHOD

BACKGROUND OF THE INVENTION

This invention concerns a permanent type foundation and building structure support arrangement which uses rectangular tubular metal support columns secured in sockets which are pre-cast in concrete piers, beams, slabs or floors. It is adaptable to factory built structures such as mobile and modular homes which are delivered on their own wheels, to factory built structures having an underframe and shipped without wheels, to site-built structures with wood or pre-fabricated floors which are elevated above ground level, and to site-built structures with cast in place concrete floors and metal columns which support walls, roofs, and/or additional framing components.

A. MOBILE HOME AND MISCELLANEOUS NON-PERMANENT FOUNDATION SYSTEMS

One of the most commonly used systems for the foundation for mobile home setup is the cinder block column, stacked on a larger solid pad block placed upon the ground. The maximum allowable height for a single 8"×16" cinder block column is 32", and the column is capped by a solid block 2"×8"×16", and one or more 2"×8" wood shims, with hardwood wedges to adjust for small height variations. This system is also widely used for portable buildings, storage and office units, etc.

There are several disadvantages to this system, which is classified as a "temporary foundation". A major disadvantage is that the ground surface moves because of freezing, dampness, etc. The severity of this problem varies with soil conditions and climate, and the result is uneven movement in the foundation and a variety of problems in the structures.

There are localities in which this system is not satisfactory because the soil is soft and deep and will not support the required load. Sandy soils might be eroded by wind or water runoff. Also, a workman will often not install the bottom pad block perfectly level, resulting in a column that is not plumb and a less secure installation. Further, at the maximum allowable height of 32", this system is unstable, and there are many installations in unlevel environments in which a greater column height would be desirable, but for which this system would be totally unacceptable. Also, cinder blocks are often used in place of the stronger concrete blocks, resulting in cracked or crushed blocks if settling results in an increase over the optimum load on a particular column.

There is an increasing use of concrete blocks placed upon concrete piers or upon concrete spread footings or beams pre-cast to ground level. This system eliminates movement because of changing soil conditions, but the other objections remain. Also it is common for the block next to the concrete to break, if the concrete has not been finished smooth and perfectly flat; and mortar is seldom used to "bed" the blocks in this system.

The use of manufactured metal stands for this type of application has gained wide acceptance in recent years. These stands usually are supplied in various heights, and have a height adjustment of two inches in each size. They are placed upon the 4"×16"×16" concrete pad block, or upon a treated plywood pad. These stands are at least as unwieldly as the concrete block column, and there is a further unsteadiness in the structures because of the looseness of the adjusting bolt in its retainer, which allows it to rock. Also, these stands are furnished in 2 inch size increments, and it is necessary to have at hand a rather large inventory in order to handle an installation without running short of particular sizes.

In most of the country the engineering aspect of manufactured housing, in regard to foundation support systems and wind resistance, is regulated by law, which typically requires the installation of anchoring devices to prevent lateral movement and/or overturning of the structures during high winds. In coastal, hurricane prone areas, these requirements are more strict because of the probability of higher velocity winds.

As a result, a rather uniform system of anchoring has evolved over the years, even though the patent art shows a large number of proposed additional solutions to this problem. The vast majority of anchoring in the manufactured housing industry is accomplished by installation of spaced "anchors" just under the edges of the structure, with a strap then attached from the structure's longitudinal frame to the head of the anchor. Many of the structures are supplied with continuous straps over the top of the structure at spaced locations, the ends of which are also attached to the head of the ground anchors. The anchor head has provision for tightening the straps by means of split bolts which are turned and secured after the strap has been threaded through the bolt.

These anchors are furnished in two basic forms. There is an auger type, which is installed with a slow turning hand-held machine, and a so-called rock anchor, which uses two straight rods which are driven in an "X" configuration through sleeves in a head unit which also contains provision for the strap bolts. There is ample reference to these anchors and the straps used with them, in the patent art. Typically, specified strength requirement for the anchors and straps is 5,000 pounds. The mechanical parts are laboratory tested for certification by government agencies and of course fulfill the requirements. However, it is only in extreme cases, if ever, that particular installations are field tested, to insure that the anchor, in the ground, does in fact provide the necessary resistance to vertical or horizontal movement which is required. It is standard practice for an installer to go to an anchoring job with a set of auger anchors and a set of drive, or "rock" anchors. He then installs the auger type anchors if possible by means of the standard procedure with the auger machine. This is the first choice for three reasons: the auger type anchors cost less, they exhibit a greater holding power than the drive anchors in a given location, and they normally are faster to install.

If the installer cannot install the auger anchors in the usual manner because of resistance of the soil, he then uses the rock anchors. There are soils which are sandy, or which stay damp, in which the auger can be installed but does not have sufficient holding power. The rock anchor in these soils would have almost no holding power. There are places where rock and loose soil are mixed, making it difficult to install even the rock anchor, which might, even so, have inadequate holding power.

Because ot this either-or choice, there are many of these installations in which the anchors do not have the mandated holding capacity. There are many varieties of soils and soil combinations, and while these two widely used anchor systems work extremely well in some locations and reasonably well in others, there are too many instances in which neither system is satisfactory. As a result, the anchoring system presently used on the majority of mobile home installations in the United States leaves many of these structures inadequately secured in the event of high winds. Further, while the cost of these systems is not prohibitive it does still run well into the hundreds of dollars in material and labor for a larger installation, such as an 80 foot long singlewide mobile home. This outlay would defray a good percentage of the cost of a reasonably price permanent foundation system which did not require the installation of an anchor system.

B. PERMANENT SYSTEMS, MOBILE, MODULAR, AND OTHERS

There also is a considerable volume in factory built housing which is similar to mobile homes in many respects, but built somewhat stronger and different in some cosmetic and some basic ways, and this type of manufactured housing is generally referred to as "modular" homes. Modular homes almost always require placement on a "permanent" foundation, and qualify differently from mobile homes in so far as government regulations, financing, and zoning restrictions are concerned. There is also a small but increasing number of mobile homes which are currently placed on permanent foundations, and some factories now build both modular and mobile home units.

Many modular units are originally shipped without wheels, on low trailers, to be skidded or crane set onto permanent foundations extended above grade. The practice is changing toward shipment of modular units, which are in most cases a portion of a double- or triple-wide home, on their own wheels and axles. This shift is under way because of the shipping and site handling costs of the crane-set method, which are altogether higher than the cost of the simple process of pulling a unit into its final location with a tow truck and simply lowering it vertically with jacks to its final elevation.

There is an urgent need in the industry for a suitable permanent foundation system which pemits positioning of non-wheeled structures, as well as wheeled structures, to the final horizontal location without having to deal with pre-installed above grade foundation piers or beams. Basic requirements for the system are low cost, along with ease of application in varied site conditions.

The "permanent" foundation systems currently in use for mobile and modular homes are evolving toward a network of piers or spread footings at grade or slightly above, which will accommodate exact placement of the structure upon its own wheels by a tow truck, or the simplified skid unloading of a non-wheeled structure into final location. After tow-truck or direct skid placement, the unit is levelled and support units are placed upon the concrete footings at spaced locations along the frame of the structure. The most common support is by concrete blocks in connection with a solid top block, wood pad, and hardwood shims. This system has the disadvantage of improper bedding of the lowest block against the concrete, causing frequent breakage, and the requirement for an anchoring system, which is most often fulfilled by the inadequate ground anchor systems referred to earlier, which are, in addition, quite expensive.

The patent art shows a considerable amount of interest in providing a mechanism which will attach to the concrete footing, beam, or pier and support a structure along its frame. These would include U.S. Pat. Nos. 3,022,980, 3,713,259, 3,830,024, 3,380,205, 4,125,975, and 4,546,581. Most of these have provisions for restraining the frame of the structure from either vertical or horizontal movement. Two of them also provide a connection for attaching a strap which goes over the top of the structure, to the device. It should be noted that it is becoming the norm for factory-built housing to be strongly attached to the frame, making the over-top straps unnecessary in most installations.

Almost without exception, these above described patents show devices which require a large amount of material and/or expensive machining and welding, making them prohibitively expensive in both material and labor to produce. Several of these patents use the very old method of attaching a column to concrete, in which a heavy place is attached to the concrete by means of four cast in place anchor bolts, and either a heavy column-enveloping socket, or the column itself, is welded to the plate. These sockets and welds must withstand the bending forces carried by the column, and they must be relatively heavy and well-connected. The threaded adjusting bolts in these devices are capable of sustaining several times the required load of 5,000 pounds. Three of the patents show support by a threaded bolt, and one by a telescoping pipe, all of which allow a certain movement in the structure after installation.

While most of these devices show a small amount of adjustment for height, this adjustment is not adequate for all installations. In order to provide for all possible site conditions, an ideal system provides for support heights which vary from a few inches to 32 inches. These limits are the accepted ones provided for in the two widely used and legally certified non-permanent systems: concrete block columns and metal stands.

There are at present relatively few permanent type installations being made with the above large variation in pier height, but this is mainly because of the high cost of installing the structure on precast concrete piers of this height, which is probably the only method available until now. Sites this unlevel are usually graded in the area of the structure in order to eliminate the variation in pier height. This grading, however, adds a substantial expense, and creates new problems of water control, appearance, and possibly retaining walls.

Also, only one of the patents, U.S. Pat. No. 3,380,205, shows a substantial lateral adjustment to compensate for mistakes in lateral alignment of the precast piers and anchor bolts with respect to the installed position of the structure frame members, and this device is prohibitively heavy and expensive.

Additionally, none of the prior patents show any provision for the instances in which a pre-positioned foundation support occurs at a point where there is a conflict with a spring hanger or a frame cross-brace on the underside of the structure frame. The lack of provisions for handling these two problems in installation makes the services of a welder a requirement in a large percentage of installations. Because installers are very seldom welders, handling this problem is time consuming and expensive.

There have been some installations using telescoping round pipe embedded in concrete, the moveable portion of which is welded at its lower and upper ends after placement of the structure. This is of course unhandy and expensive, and the lower weld must be heavy enough to equal the bending strength of the pipe. This system is rather awkward to prepare when the concrete is poured, as are many of the others in the patent art which require the exact positioning of four anchor bolts for each device.

There is at least one product offered commercially which bears a resemblance to one of the patents cited previously. It has not been widely accepted in the industry, because its price is high as a result of its design and method of manufacture, and it is offered only in one basic weight with a limited two inch height adjustment. This limited height range requires machine grading of the site, and very accurate finish leveling of the concrete footings, as the variation in the frame of the structure can, by itself, require an inch or two of height adjustment along its length.

Another permanent type system has only recently been certified for use with their modular units by some manufacturers, and is gaining acceptance by installers. It entails the use of the previously mentioned metal jack stands, along with a steel plate, typically ¼" thick and 16" square, which is fitted with four welded anchor rods on one side. These plates are positioned in freshly poured piers, beams, or runners, approximately at grade level. The anchor rods extend into the concrete, and the lower side of the plate rests upon the concrete surface, which must be level. The modular unit is rolled into place after the concrete has set, and it is leveled. A metal jack stand of the proper height is placed upon each foundation plate and adjusted to the frame of the unit. A welder then welds the bottom of the stand to the plate in four locations, welds the adjusting nut to the stand and to the adjusting bolt, and welds the top support plate (which is connected to the bolt) to the frame member.

This system has obvious disadvantages, which include the expense of the heavy plates with their welded anchor members, the requirement of a large inventory of jack stands, and the considerable amount of welding necessary at the job site. However, in spite of these drawbacks, it is viewed by some experienced installers as the best choice which has been available until now. In contrast, the subject invention requires far less material, is composed of fewer pieces, requires a smaller inventory of parts, is easier to install, and requires no welding at the job site.

The manufacture and installation of mobile homes was practically unregulated by law in the early 1970's, but since that time there has been a steady output of new laws in this field by federal, state, county, and local governing bodies. A large amount of this regulation is directed toward foundation systems which provide support along with resistance to movement from wind forces. In many cases zoning ordinances take the type of foundation into effect, when considering placement of mobile or modular homes, and some municipalities have written their own specifications for foundations for mobile and/or modular homes.

Before a new system can be placed on the market for volume sales it must be tested and then certified by the states, and to be acceptable to the total market it must also be approved by F.H.A. and other federal government agencies. This makes it unlikely that a new system will succeed commercially unless it overcomes most of the many disadvantages of the currently used systems in respect to cost, flexibility of application, ease of installation, permanence, and strength.

C. SITE BUILT SYSTEMS

Site built structures with wood floors above ground level have made extensive use of the concrete block columns, stacked either upon a pad block or upon a grade-level concrete pier or beam. Shims of various kinds are used to obtain an exact elevation for each column when the support beams are fabricated upon the columns. In site-built practice this non-permanent type of foundation usually is not accompanied by provision for securing the structure against either horizontal movement or uplift forces from high winds. This system is relatively inexpensive, but is subject to the same problems discussed earlier in respect to its use with mobile homes.

A permanent system in widespread use for structures with wood floors above grade utilizes cast in place concrete piers upon which the structure is then built, using wooden beams, then floor joists, etc. This system has several disadvantages. Its cost is rather high, considering the labor and the concrete and reinforcing steel used above grade, along with material for forming the piers above grade. Further, a transit level must be used to assure the correct elevation of each pier, and some provision must be made at the job site to secure the wooden beams to the top of the concrete piers.

Site-built structures which are metal columns attached to cast in place concrete floors most often use a prefabricated column and base plate arrangement, which is secured to the concrete floor by means of anchor bolts. Usually four or more anchor bolts are used per column, and placing these anchor bolts in the proper location and depth in the concrete to line up with the individual holes in the base plate of each column in the structure is an involved and labor consuming process. It is too often necessary to alter the holes in the base plate of some columns with a torch when placing the columns.

A less widely used method is that of pre-placing the columns, and pouring the concrete around a lower portion of the columns. This insures a strong support of the columns, but requires the complicated process of securing the columns in the proper location, attitude, and elevation while complete preparations are made for pouring the concrete.

In addition to the devices from the patent art mentioned earlier in connection with mobile-modular homes foundation systems, there is one particular patent, U.S. Pat. No. 3,653,169, which pertains to site-built structures and falls within the field of the present invention, that should be discussed. This system not only has the disadvantages mentioned earlier in connection with the manufacture and bolting of a base plated column to a concrete member, but requires the additional expense of forming the concrete at each column location into a raised, hollow block. A very limited height adjustment is provided by means of shims, and the clamping mechanism itself has a large number of parts not easy to manufacture. While this system may well be practical in some applications, it uses a very large number of parts and an extreme amount of labor to accomplish the task of joining a tubular support column to concrete. In addition, the raised concrete base is unsightly as well as being impractical in some applications.

SHORT STATEMENT OF THE INVENTION

This invention provides a lightweight, low cost socket which is inserted into wet concrete. After the concrete has set, a tubular column is placed in the socket and secured by friction created by a wedge driven into the socket beside the column. The socket has three vertical sides and one side slanted to match the angle of the wedge. In use, the socket itself does not contain the very large pressure created by the wedge; it simply passes this pressure directly into the concrete socket created by, and enveloping, the metal socket.

In one embodiment the socket is deeper, and height adjustment is provided by positioning the column at the proper height before driving the wedge. This embodiment uses a bolt and bracket to further tighten the driven wedge upon any tiny movement of the column toward the socket.

In another embodiment, a simple and sturdy bolt and bracket system is provided for attaching the upper end of the column to an I-beam frame such as that used on manufactured housing. Provision is made for unintentional lateral misalignment of the frame with the column, as well as for different width I-beam flanges and for the instances in which part or all of the frame member consists of a joined double I-beam.

Columns are provided in several lengths, which in conjunction with the height adjustment provided by the deep socket, provides support at any height over a wide range. Smaller columns along with thicker wedges are provided in the shorter lengths, allowing insertion into the socket even though the structure frame is in place only inches above the socket.

This range of height accommodation allows the easy and inexpensive, permanent installation of manufactured housing or other structures on either level or unlevel terrain. Further, a device is provided to adapt the top of the column for attachment to the frame member at or very near a spring hanger or brace connection. Another device bolts to the top of the column to accommodate an even larger unintentional lateral misalignment with the frame of the structure. An alternative construction of the column uses a permanently attached plate at its upper end, the plate having holes to accommodate attachment to the structure frame.

In another embodiment the top of the column is provided with means for attachment to wooden beams for site-built structures. In level or unlevel terrain the deep sockets are inserted into wet concrete in piers, beams, or spread footings, approximately at ground level. Later a string is levelled at the proper height along each line of locations, and a column of the proper length is selected, inserted into each socket and matched to the string height before the wedge is driven.

In yet another embodiment the sockets are either pre-positioned in, or inserted into, the freshly poured concrete of the floor slab of a site built structure, and columns of a predetermined length are later secured in each socket. Wall, roof, and/or additional framework are then welded and/or bolted to the columns. This system also accommodates prefabricated site erected metal buildings, in which the column may be part of a column and truss unit.

BRIEF DESCRIPTION OF THE DRAWINGS

Other objects, features and advantages of the present invention will become more fully apparent from the following detailed description of the preferred embodiment, the appended claims and the accompanying drawings in which:

FIG. 7 shows perfect lateral alignment; FIG. 8 shows lateral misalignment; and FIG. 9 shows misalignment of a double I-beam frame;

DETAILED DESCRIPTION OF THE PREFERRED EMBODIMENT

Figure 1:
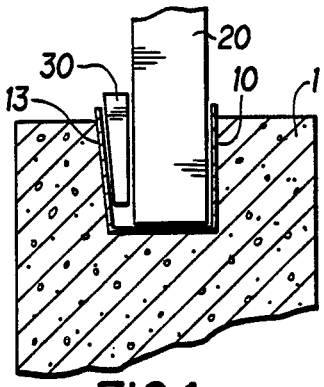
FIG. 1 is a side view of the column and wedge in the socket in concrete, in partial section.

The preferred embodiment of the present invention is illustrated by way of example in FIGS. 1–25. Throughout this discussion and the drawings, the number 1 is used to designate the concrete in which the various sockets are embedded, regardless of whether the concrete is in the form of a pier 1, slab 1, spread footing 1, or beam 1. Local soil conditions and other considerations dictate the type and size of the concrete portion of the foundation. The most economical type, which is satisfactory in a majority of installations, is the vertical pier 1 of 12 to 18 inches in diameter. It extends into the ground to a minimum depth of 30 inches. This depth is increased in areas of extreme weather conditions, or when the metal column extends above grade more than 30 inches. The piers 1, or other concrete members, are reinforced in a normal manner known in the art, and the pier configuration requires some horizontal reinforcement in the area of the socket as shown in FIG. 3.

Figure 2:
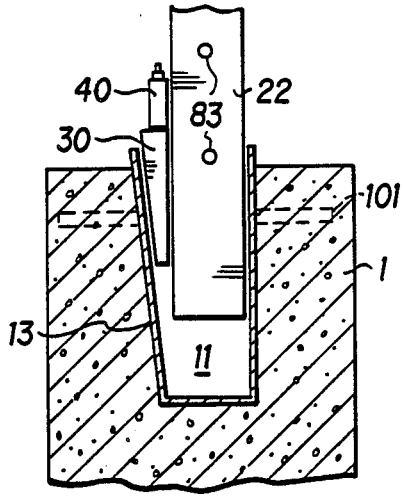
FIG. 2 is a view of a deep socket and column, wedge, and retaining bracket in partial section.
Figure 3:
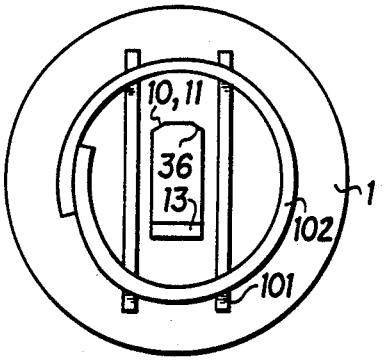
FIG. 3 is a plan view of the pier with a reinforcing member, and showing an alternative socket construction.
Figure 4:
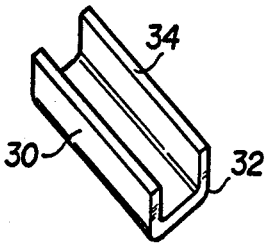
FIG. 4 is a perspective view of one embodiment of the wedge.
Figure 5:
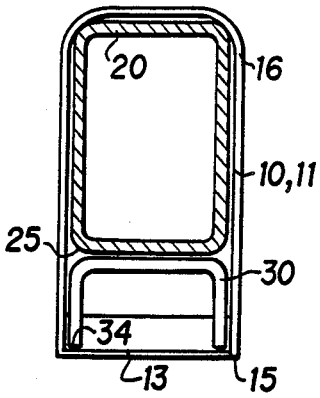
FIG. 5 is a plan view, in partial section, of the column, wedge, and socket showing an embodiment of the socket which contacts the column at its corners.
Figure 13:
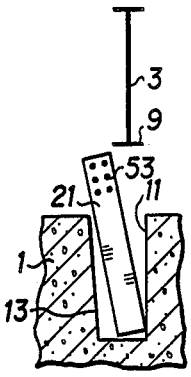
FIG. 13 shows the shortest length of smaller column being inserted into the deep socket after the underframe is in place close to the ground and the top of the socket.
Figure 14:
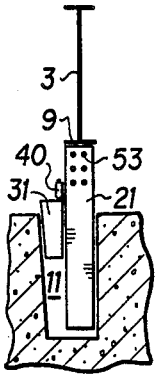
FIG. 14 shows this column in place, adjusted to height, with the wedge in place.

The basic socket 10 is shown in cross section in FIG. 1 and in plan in FIGS. 3 and 5. It is constructed from a thin metal, and has three vertical sides and one slanted side 13. The socket 10 is inserted into the concrete member 1 while the concrete is wet, with its open top slightly above the concrete surface. An alternate deep socket 11, see FIGS. 2, 13, and 14, provides several inches of height adjustment for columns 20, 21, and 22, and is used in all installations requiring column height adjustment.

When using piers 1 for the concrete portion of the foundation in connection with placement of a mobile home 4, see FIGS. 18, 19, and 20, or other structures having an underframe 3, see FIGS. 7, 8, 9, 13, 14, 15, 16, and 17, the procedure is as follows: the desired location is laid out with a string stretched at ground level in the vertical plane of the final position of each of the frame members 3. Stakes are driven in the ground at the end points, and along the strings at the proper spacing, which varies for manufactured structures from a maximum of 10 foot centers, to a minimum of 6 foot centers. The string is temporarily removed, and a pier hole is dug at each staked location, by hand or machine.

Figure 18:
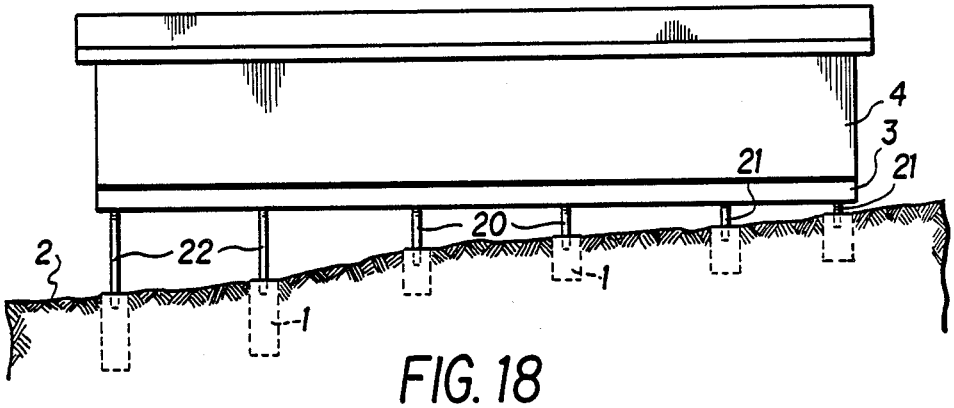
FIG. 18 is a side view of a structure installed on uneven ground, using the adjustable height deep sockets, and columns supplied in a variety of lengths.
Figure 19:
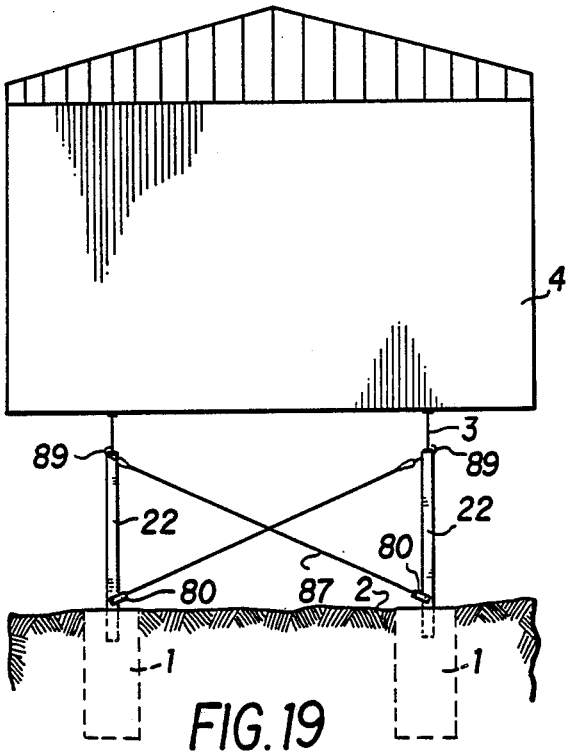
FIG. 19 is an end view of a mobile home or other structure, showing the bracing strap arrangement used with very tall columns.
Figure 20:
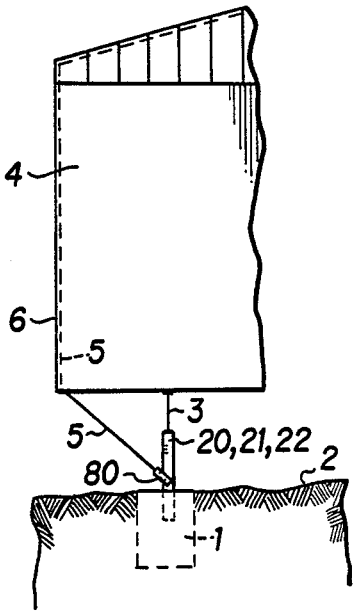
FIG. 20 is a partial end view, as above, showing an over-the-top strap connected to the column.

After reinforcing steel is placed vertically in each hole, the concrete 1, see FIGS. 1, 2, 3, 13, 14, 18, 19, 20, is poured to ground level 2, see FIGS. 18, 19, 20, and the strings are replaced. A socket 11, which provides height adjustment for column 20, is then aligned with the string, in the center of each pier, and pressed into the wet concrete 1, and a short piece of reinforcing steel 101, see FIGS. 2 and 3, is placed two inches under the concrete surface, next to each long side of the socket. An additional/alternate reinforcement consists of a smaller size bar which adds a complete circle 102 to the two straight pieces beside the long sides of the socket. FIG. 3 shows a top view of a pier 1 with socket 10 or 11 and reinforcement 102 in place. After the concrete 1 has slightly set up, each socket 11 is checked to insure that its exposed end is level. A time for curing of the concrete 1 is allowed to pass, and the housing structure 4 is rolled into place on its own wheels, or otherwise positioned, after which it is lowered, leveled, and secured to columns 20 and 21, see FIGS. 1 and 13, placed in the sockets 11.

If an alternate form of concrete structure 1 is preferred, such as beams 1 or spread footings 1, a positioning layout is used which places the sockets 11 in the proper locations within the concrete member 1, these locations falling within the vertical planes of the final position of the structure frame members 3.

An important advantage of this system is that it works just as well if the elevation of the individual sockets 11 varies. It is completely satisfactory, and usually less expensive, to place the concrete 1 surface at grade level 2, see FIGS. 18, 19, and 20. This is true in the case of spread footings 1 and beams 1, as well as with piers 1. This style is more pleasing aesthetically, and eliminates the need for above-grade forming for the concrete. In many cases no forming at all is necessary for placing of piers 1, beams 1, or footings 1. (See FIG. 18)

The fact that the surface of a beam or footing follows the unlevel ground surface does not present a problem, and it is immaterial whether the concrete surface is finished or left rough. It is only necessary that each socket 11 is positioned in the vertical plane of its respective frame member 3, and that it is plumb. In cases where the beam 1 or footing 1 follows the ground surface and is noticeably unlevel, it is necessary that the concrete in the immediate vicinity of the socket 11 be leveled to the point that there is no more than approximately one-half inch variation in the distance from the concrete surface to any point along the open end of the socket 11.

Referring now again to the drawings FIG. 1 shows a basic embodiment in a partial section side view. The concrete 1 envelopes the socket 10 to a point approximately ½ inch below its upper, open end. The column 20 is inserted into the socket 10, after which the wedge 30 is inserted between the column 20 and the slanted side 13 of the socket 10, and tightened by hammer blows to the wedge's upper end. All sides of the socket 10 are flat, and with the exception of slanted side 13, opposite sides are parallel to each other and perpendicular to the bottom end and open top end of the socket 10. The wedge 30 is inserted with its open side, and surfaces 34, toward the slanted socket side 13 (refer to FIG. 5), and with its closed surface in contact with the column (refer to FIGS. 5 and 6). A deep socket 11, see FIG. 2, provides height adjustment for columns 20, 21, and 22. Holes 83 extend through the extra long columns 22 only, see FIGS. 2, 18, and 19, and receive bolt 86 for securing bracket 80 (See FIG. 22).

The socket 10, and the socket 11 which provides height adjustment, are formed from a relatively thin material, preferably steel. It is not required that sockets 10 or 11 contain the forces generated by the driven wedge 30, or that they contain the forces generated by the column 20 within the socket because of lateral loads upon the upper portions of the column 20. These forces are simply passed through the metal socket 10 or 11 into the concrete socket, which was formed by and envelopes the metal socket 10 or 11. The metal socket 10, 11, then, requires only enough strength and rigidity that it retains its shape in shipping, handling, and forming the wet concrete 1 around it. When the socket 10 or 11 is formed from more than one piece of sheet metal, the seams do not have to be continuously joined or strong; for instance, spot welding is sufficient. The seams do not need to be completely waterproof; they must only be small enough to prevent the entry of coarse sand. The exact dimensions of the socket 10 and 11 are not critical, as a small allowance is made to accommodate slight variations in the dimensions of the standard specification rectangular structural tubing, which is cut into lengths to make the columns 20. Column 22 is identical to column 20, except that column 22 is longer and contains holes 83 to accommodate bracing bracket 80. The socket 10 or 11 is an item that is easy and inexpensive to manufacture, it is made from a small amount of standard sheet metal, requiring only basic forming and spot-welding in which there are no critical dimensions.

It should be noted that socket 10 and 11, described above, and variations of socket 10 and 11, which are discussed later, do not have any features intended to serve the purpose of anchoring the socket 10 or 11 to the concrete 1. In use, the socket 10, 11 is inserted into wet concrete 1, which forms a concrete socket in intimate contact with all portions of the exterior of the metal socket 10 or 11. When cured, this concrete socket enveloping the metal socket 10 or 11 is extremely strong and is capable of withstanding extremely large pressures without failure.

The wedge 30 generates a large horizontal pressure when it is driven, and this pressure is contained by the slanted side 13 of the concrete socket, near the slanted wedge surface 34, and the opposite side of the concrete socket. This pressure is borne equally by, and passes through, the four items which are in position, in series, between the two concrete surfaces; the column 20, the wedge 30, and the two separate sides of the metal socket 10 or 11. In use, the column 20 is secured in place by pressure placed upon it by the wedge 30 surface, and is prevented from vertical movement, either up or down, by friction between its one surface and the adjacent wedge 30 surface, and its opposite surface and the surface of the metal socket 10 or 11. The wedge 30 is likewise restrained from vertical movement by friction between its one surface and the surface of the slanted wall of the metal socket 10 or 11, and by friction between its other surface and adjacent column 20 surface.

The lightweight metal socket 10 or 11 does not independently handle stresses between its portions on the order of the vertical load requirements of the column 20 and socket 10 or 11 arrangement under discussion (refer to calculated data and laboratory test results disclosed in detail below). It is not necessary that the socket 10 or 11 sustain these forces, however, because the forces that are applied to the metal socket 10 or 11 at the various locations are passed through to the concrete socket at these same various locations. The metal socket 10 or 11 of this invention serves principally to form the concrete socket in the proper shape and size, and to provide a metal surface to protect the surface of the concrete socket from scouring by the wedge 30 and column 20 surfaces.

A series of experiments were performed which serve to clarify the manner in which the components of this invention interact with each other and with the concrete socket. A socket 11 was constructed with two sides, the one which contacts the wedge 30, and the opposite side, barely attached. This socket 11 was cast in concrete, and the two sides, referred to above, were later removed exposing the concrete socket on the side which supports the wedge and on the opposite side. Another, slightly smaller piece of the same sheet metal was placed loosely in the place of each of the missing socket 11 sides. Columns 20 were installed in turn with wedges 30, and a series of vertical load tests, both upward and downward, were performed. There was no discernable movement of the unattached portions of the socket 11, and the results were no different from results obtained in tests of complete sockets, which are reported on in detail later in this discussion. The above experiment shows that the position of the metal socket 10 or 11 is maintained within the concrete socket by friction between the metal socket 10, 11 and concrete socket, this being the friction caused by pressure exerted by the wedge 30, which is contained by the two opposite sides of the concrete socket.

Tests show further that a heavier metal socket, which absorbs the forces generated by the wedge 30, requires separate anchor means to maintain its position in the concrete 1. This is so because there is no pressure generated between the heavy metal socket and the concrete, after the concrete 1 is cured, to supply friction, as is the case with the thin socket 10 or 11 under discussion. The socket 10 or 11 of the present invention, then, allows unsophisticated fabrication techniques, using inexpensive lightweight materials, and at the same time removes the necessity for anchoring devices or other costly features.

The column 20, as mentioned above, is a length of standard structural tubing. In the production process this tubing is cut by a large band saw while still in long factory bundles of approximately 20 pieces. This basic and inexpensive method of cut-off is the only process required in manufacturing the column 20 and 22 except for the drilling of holes 43, 53, and 83.

The wedge 30, as shown in FIGS. 1, 2, 4, 5, and 6, is cut from rectangular structural tubing, which has the same wall thickness and overall thickness dimension as the column 20, but not necessarily the same overall width dimension as column 20. In the intermediate lengths, from 20" to 36" approximately, the column 20 as tested is fabricated from 2"×3"×3/16" structural steel tubing. The wedge 30 as shown in FIG. 1 is one-half of a 6" length of 2"×3"×3/16" tubing, sawed lengthwise to split the 3" dimension at the proper angle to match the angle of the socket 10 or 11. The mean larger horizontal dimension of the socket 10 or 11, is calculated to equal the mean thickness of the wedge 30 plus the larger dimension of the column 20. In the above illustration the mean larger dimension of the socket 10 or 11, is the column 20 width, 3", plus one-half of the 3" stock which is split to form the wedge 30, for a total mean dimension of 4½". An alternate method of fabrication of the wedge 30 entails blanking and forming it from sheet material.

It might appear that the wedge 30 could have other configurations, such as being solid, and work the same. However, laboratory tests, explained in more detail later, have shown otherwise. To begin with, the surfaces of the rectangular tubing stock are not exactly flat and parallel. As a result, for maximum effectiveness, the wedge 30 must be able to conform to the tubing by twisting slightly under the extreme pressure created by its being driven into the slightly angled cavity. If one of surfaces 34 of the wedge 30 builds up a substantial pressure before the other surface 34, it causes a slight deformation in the wedge 30 at rounded corners 32, until the slight differences in overall dimensions of the column 20, 22 are accounted for and the wedge 30 supports an equal load on each of its free edges 34.

FIG. 5 is a plan view, in partial section, of the column 20, and wedge 30 in a second, preferred embodiment of the socket 10. Because of the slight variation in the dimensions of the mill run tubing, the small interior dimension of the socket must allow some slight clearance to allow easy insertion of the column 20 into the socket 10 or 11. In a square cornered socket 10 or 11, see FIGS. 1 and 2, this allows a small lateral movement of the upper end of the column 20 in the direction not directly controlled by the wedge 30 pressure, or parallel to the contact surfaces between the column 20 and wedge 30. This second embodiment of the socket 10 or 11, however, has its corners 16, opposite the wedge 30, rounded with a radius somewhat larger than the radius of the column 20 corners. The pressure exerted by the wedge 30 against the flat side of column 20 is passed into the socket 10 or 11 at contact points along a line in each socket 10 or 11 corner 16. These two contact areas shift along the curved surfaces of the column 20 and the corners of the socket 10 or 11 if the opposing forces between them are unequal. This causes the column 20 to twist slightly in socket 10 or 11, in either direction, facilitating the equalization of pressure upon the two free edges 34 of the wedge 30, thereby minimizing the problem caused by the uneven contact surfaces of the wedge 30 and column 20.

There is also a more obvious result which is achieved by the rounded corners 16 of the socket 10 or 11. As shown above, there is a large force between the corners of the column 20 and the corners of the socket 10 or 11, on the side away from the wedge 30, which is at an angle to the flat sides of the socket 10 or 11 and wedge 30. The force from the wedge 30 prevents movement of the free end of the column 20 in a direction perpendicular to the contact surfaces between the wedge 30 and column 20 as in the primary embodiment of the socket 10, 11 but in this preferred embodiment, movement of the free end of the column 20 in a direction parallel to the contact surfaces is also prevented. Thus the two rounded corners in the socket 10 or 11 allow for the provision of the clearance necessary because of size variation in the column 20 material, and also eliminate the problem of lateral movement of the free end of the column 20 in any direction.

FIG. 3 is a plan view of a concrete pier 1, showing a combination reinforcing member 101, 102, and also showing a second preferred form of socket 10 and 11. This socket 10, 11 has beveled rear corners 36, which achieve a result similar to that produced by rounded rear socket 10 or 11 corners 16 discussed above. The beveled rear corners 36 facilitate a twisting of column 20 to permit a proper fit between unsquare surfaces of column 20 and wedge 30, and also prevent any lateral movement of the free end of column 20. The force transferred through the socket 10 or 11 at its rear corners is always perpendicular to that section of the socket 10 or 11 sidewall section 36, regardless of the exact alignment of column 20. This permits a preselected direction for these rear corner forces, by way of a selected angle for the rear corner bevel section 36.

FIG. 2 shows an alternate embodiment of the socket, referred to as the deep socket 11. This deep socket 11 provides for a height adjustment of the column 20 by providing an additional open space below the wedge area. In FIG. 2, the column 20 is shown in its intermediate position. According to the requirements of an individual location, column 20 is used in any vertical location to the point that its lower end is as high as the bottom of the wedge 30 or as low as the bottom of the socket 11. The depth of the socket 11, and therefore the amount of height adjustment for a particular length of column 20, is influenced by several considerations. The cost of the socket increases slightly with its depth, and the average amount of unused, or wasted, column 20 increases as the adjustment span is increased. Also, problem associated with inserting the column 20 into the socket 11 after an underframed unit is lowered into place, increase with increased adjustment length on the column 20.

Referring again to a column 20 which is 2"×3"×3/16" thick, laboratory tests indicate that in order to utilize the maximum strength of the column 20 in regard to lateral movement of the free end, it is necessary that the wedge 30 have effective contact with the column 20 for a distance somewhat greater than the larger dimension of the column 20. 4" is used for this dimension, and this 3"×2" column 20 is successfully employed in practical application with a 4" height adjustment. The total vertical dimension of the socket 11 is 9", which allows ½" above the concrete surface and ½" clearance for the insertion of the column 20.

Height adjustment of column 20 in socket 11 is a simple process of inserting the column 20 and wedge 30 into the socket 11, lifting the column 20 to contact the frame member 3, or indicator string, with one hand, and driving the wedge 30 with the other hand.

Figure 6:
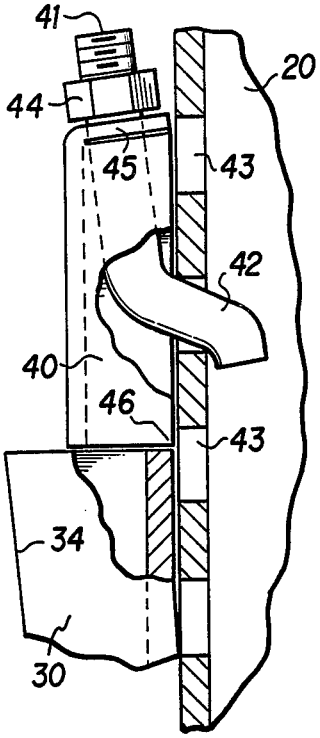
FIG. 6 is a larger, fragmentary view of the column, wedge, and retaining bracket and bolt.

FIGS. 2 and 6 show a system which provides the maximum vertical load capacity for columns 20 and 22 in deep socket 11, regardless of the amount of force used to drive wedge 30. Bracket 40 is shown with its bolt 41 which secures it to column 20 by engagement in one of the holes 43 in column 20. Bracket 40 rests against wedge 30 at its corners 46, and insures that any tiny movement by column 20 in a downward direction is accompanied by an identical downward movement of wedge 30. Downward movement of the wedge 30 increases the vertical load capacity of the column 20 because of the increased horizontal pressure exerted by the wedge 30, thereby requiring an increased load if further movement is to result. Holes 43 are spaced approximately 1" apart, so that nut 44 on bolt 41 provides enough adjustment to cover the space between each of them. In this case a total adjustment range of column 20 of 4" requires four holes 43 in column 20. Bolt 41 is angled near its lower end 42 as shown in FIG. 6, so that it can be tilted slightly and inserted into proper hole 43. Bracket 40 is a channel, formed from sheet steel, with an open lower end and a flap 45 over the upper end, at an angle, with a hole in the flap to maintain the position of bolt 41.

For reasons to be explained later, it is desirable that the angle of the wedge 30 be small, in the general range of 5 to 10 degrees, and certainly not over 15 degrees. The requirement for vertical load capacity for columns, piers, or stands used with mobile homes, modular homes, and other types of factory and site built structures varies somewhat depending upon the manufacturer's specifications and/or the local or state agencies which have jurisdiction. However, there is agreement among a majority of these groups that a 5,000 pound vertical load capacity for each support member is sufficient. The 2"×3"×3/16" structural tubing referred to earlier has of itself a vertical load capacity many times the 5,000 pound capacity required in its use as a support for factory built housing, etc. In connection with the use of this material in the present invention as an adjustable height column 20, we need only to consider the holding power of the socket 11 and wedge 30 and the additional helpful effect of bracket 40.

Laboratory testing has shown that the vertical load supported by the column 20, varies upward as the wedge 30 is driven harder, as would be expected. It is routine, and not difficult, to obtain readings of 5,000 to 8,000 pounds of load capacity by medium driving of the wedge 30, without the use of bracket 40. It is interesting to note that when bracket 40 is not used and overload failure occurs, the column moves only slightly, after which the load must be again brought to the same overload amount to produce another slight movement. In other words, an overload produces a movement which will cease when the load is slightly reduced. The column 20 has a given overload force with a given amount of wedge 30 driving effort, and even though this overload is continuously applied, the column 20 will resist movement until it bottoms out in the socket 11, the amount of sustained resistance matching the above determined maximum load force.

When bracket 40 is used, a very short downward movement increases the load capacity appreciably. The load required to produce failure is the same with a particular column 20, wedge 30, and bracket 40 with bolt 41, whether the wedge 30 is driven hard, or not at all, before the bracket 40 and bolt 41 are installed. The only difference is in the slight distance the column 20 moves while loading, before failure. When using the column 20, and wedge 30 as described above, failure due to deformation of the wedge 30 and column 20 occurs regularly at between 14,000 and 16,000 pounds. In these tests a hardened ⅜" bolt was used for bolt 41, on bracket 40. When a standard ⅜" bolt was used, failure occurred in the bolt 41, where it entered hole 43 in the column 20, at between 10,000 and 12,000 pounds. This system, using the components as above, therefore has a 100% or more overload factor when used where a 5,000 pound maximum load capacity is required.

Figure 7:
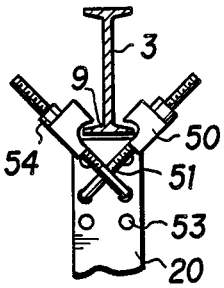
FIGS. 7, 8, and 9 show the upper end of the column attached to a structure underframe, which is in cross section.

FIG. 7 shows a mechanism for attaching the top end of the column 20 to the I-beam frame member 3 it supports, to prevent upward or lateral movement of the frame member 3 with respect to the column 20. The I-beam frame member is shown in cross section. A pattern of several holes 53 drilled in the wide side of column 20 during its manufacture, and two formed bolts 51 are used, each with its bracket 50, to secure the I-beam 3 to the column 20 by means of its flanges 9. The holes 53 in the pattern are located and spaced so that a proper connection is possible for a perfectly aligned column 20 and frame member 3, as in FIG. 7, as well as for a case of misalignment in which the center web of I-beam 3 is aligned with one side of the column 20, FIG. 8.

Figure 9:
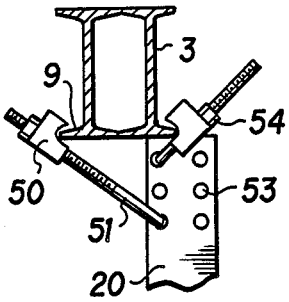
Figure 11:
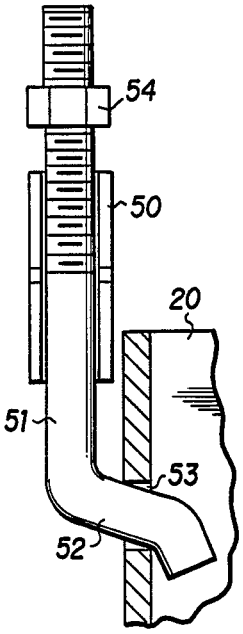
FIG. 11 is a larger sectional, fragmentary view of the upper end of the column, with the bolt and bracket in place.
Figure 12:
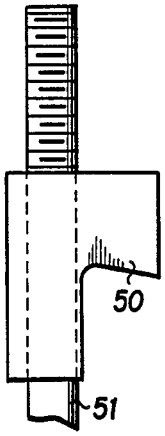
FIG. 12 is a side view of the bracket with the bolt in place.

Some manufactured units have a double I-beam 3 along part or all of the length of the unit, and FIG. 9 shows how an extreme case of misalignment with the doubled beam 3 is handled. FIG. 11 shows the retaining bolt 51 with its formed portion 52 connected to column 20 by way of one of the holes 53. The retaining bracket 50 is shown in greater detail in FIGS. 11 and 12. This bracket 50 is shaped and formed from sheet metal. This system secures a range of sizes of I-beam frame members 3 to the top of the column 20, while compensating for misalignment of the frame member 3 with the column 20 when necessary. The bolts 51 are furnished in two or more lengths.

Figure 10:
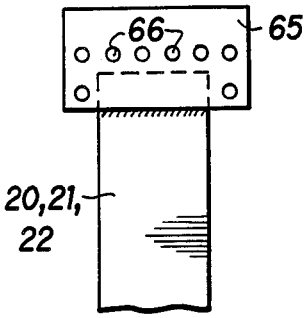
FIG. 10 is a frontal view of an alternate method of construction of the upper end of the column.

An alternate construction of the top of columns 20 and 21, includes the welding of a plate 65 to the top of column 20, 21, see FIG. 10. Plate 65 has a pattern of holes 66 to receive bolts 51 for securing frame 3 by means of bracket 50. This method using plate 65 makes every column 20, 21 eligible for installation at any point along the frame 3, whether there is an obstruction such as spring hanger 8, see FIG. 15, or not. Plate 65 extends laterally on each side of column 20,21, allowing a larger unintentional misalignment of frame 3 with column 20,21 in either direction.

The connection of the frame member 3 to the top of the supporting column 20 serves a double purpose: it prevents lateral movement of the supported unit due to horizontal wind loading, and it prevents the upward movement of the unit or one side of it due to overturning wind forces. These two forces must, of course, be borne by the column 20 and socket 11, and will now be discussed separately, beginning with the horizontal wind force.

The socket 10 or 11 and column 20 are positioned so that the largest lateral loads upon the column are in the direction of the larger dimension of the column 20, that is, toward and away from wedge 30 (refer to FIG. 5). This utilizes the greater strength of the column 20 in that direction, thereby minimizing its size, weight and cost. In the case of mobile or modular homes, along with a majority of office, storage units, etc, with an underframe 3, this direction of the greater lateral (wind) loading is in the direction perpendicular to the frame members 3, as the dimension of these units is almost universally greater along their frame members 3 than across them. This, then, requires that when a rectangular cross-section is used for the column 20 of this invention, the larger dimension of the column 20 is positioned perpendicular to the frame member 3 (refer to FIGS. 15 and 16). The side of the socket that receives the wedge is positioned toward the outside of the unit for accessibility.

Laboratory tests have shown that the strength of the socket 10 or 11 and wedge 30 is such that lateral loading upon the free end of the column 20 is limited only by bending strength of column 20, itself. In other words, when an increasing lateral load is applied to the free end of the column 20, the column 20 bends without failure of the socket 10 or 11, wedge 30 or the portion of the column 20 within the socket 10 or 11. This is the case with the square-cornered sockets 10 in FIG. 1 and 11 in FIG. 2, and also with the round cornered socket 10, FIG. 5. The properties of structural tubing are well known and calculation of resistances to bending forces upon these columns have been considered. Laboratory tests have confirmed the calculations and furnished data concerning the socket 10, wedge 30, etc., and the strength and holding power of these items.

There are many variables which together determine the wind load (horizontal force) requirement for the individual column 20 in a particular application. These include the number of parallel frame members with column supports (whether single wide units with two frame members 3 or doublewide units with four total frame members 3); total height above ground to roof peak; maximum wind loading to be prepared for (normally 15 pounds per square foot inland and 25 pounds per square foot in hurricane prone or coastal areas); safety factor (usually 50%); and spacing of columns 20 along the frame 3. To summarize, the 3"×2"×3/16" column 20, discussed above, along with the socket 10 or 11 and wedge 30 as outlined, is sufficiently strong to be installed to a height of 30" above grade 2, in all but the most demanding installations that this inventor has considered, without cross braces 87, shown in FIG. 19.

This height range will cover an overwhelming majority of all installations, and when an installation requires only some of its columns 22 over the safe unsupported height, only those over-height ones will require cross-bracing. Refer to the installation depicted in FIGS. 18 and 19, in which only those columns 22 require the cross-bracing (details of the cross-bracing are discussed later).

Column 22 is almost identical to column 20, in a series of longer sizes, above 32". It always has holes 83, to secure bracing bracket 80, which columns 20 might not. It should be noted that one of the advantages of this invention is the fact that no bracing is required by most installations using it, and the installation of separate anchors is never required. In most installations of double-wide, Four-frame 3 units, no bracing is required with this system up to the 48 inch height, which covers all but the most unusual situations.

A brief illustration of the horizontal loading requirement at the free, upper, end of a column 20 can be shown, keeping in mind that the height of the column 20 has no effect on this requirement *except* that the taller column increases the total height of the structure above ground, thereby increasing the area to be used for wind load calculations. It should be noted that the bending moment upon the column 20 for a particular wind load force upon the free end of the column 20, increases as a function of the column 20's free length, therefore the bending strength requirement of the column 20 increases as its free length increases. The shorter columns 21 of this system are therefore a smaller column, 2"×2"×3/16" structural tubing, shown in FIGS. 11 and 12 and discussed later.

In many inland areas the wind load requirement is 15 pounds per square foot plus a 50% safety factor. A typical singlewide mobile home 4 has an overall installed height of approximately 13 feet. When the spacing of the columns under each of the two frame members is 10 feet, then two opposite columns together must resist a wind force of 15 pounds×1.5×10×13 which equals 2,925 pounds, or 1,463 pounds each column. Laboratory tests have shown that the 3"×2"×3/16" structural tubing (column 20) supports this load with a free length in excess of 30" and that the 2"×2"×3/16" size (columns 21) supports this load with a free length in excess of 20".

The wind load requirements for each column 20, 21 in support of a double-section unit as compared to a single section unit is cut by more than half; the double section unit has four columns 20 or 21 for each section of exposed wall, and it is ordinarily somewhat higher to its roof peak; however, the column 20 or 21 spacing is usually less than 10 feet. In this case the strength of the 3"×2"×3/16" column 20 is sufficient to allow its use with a free length of as much as 60 inches in a majority of doublewide installations, without any lateral bracing. In hurricane prone areas with a 25 pound wind loading requirement, these height limits for column 20 are reduced by 40 percent.

In order to eliminate separate achoring requirements, it is necessary that the columns 20, 21 are attached firmly to the underframe 3 (FIGS. 7, 8, 9, etc.), and that they resist lateral and upward movement of the underframe 3. In order for the column 20, wedge 30, socket 10, 11 arrangement of this invention to resist upward movement of the installed column 20, and to exhibit the proper load bearing characteristics, the angle of the wedge 30 must fall within certain limits. If the wedge 30 is too "blunt", i.e. there is too large an angle between the planes of its two long contact surfaces, it will support a relatively larger load but will not adequately resist an upward force. However, if the angle is too small, the resistance to upward force is larger, but more downward movement occurs during loading, and the maximum downward load before failure is reduced.

The wedge 30 of this invention is designed after full consideration of vertical loading requirements, both upward and downward, variations in the small vertical movement of the column 20 during downward vertical loading, and characteristics of failure after upward overload (whether sudden or gradual).

The required resistance to upward movement which must be exhibited by each foundation column 20 or 21 is arrived at by calculating the wind induced overturning moment upon the supported structure. Determining factors include the side surface area of the structure, the distance above ground of the median height of this area, the weight of the structure, its roof area, and its frame width. This resistance requirement is most stringent for singlewides in the coastal zone, decreasing to a much lower figure for doublewides, particularly in the inland zone.

In the coastal zone, the maximum horizontal wind loading to be prepared for is 25 pounds per square foot, and the maximum uplift is 15 pounds per square foot, plus a 50% overload factor for both forces. Most 14 foot wide singlewide mobile homes have a 99" frame width, and one of these which has a 20 pound per square foot dead weight, as specified by the manufacturer, would typically be set up in the coastal zone on supports spaced 8 feet on center. In this particular illustration, the required resistance to removal for each pier 20 or 21 would be 1,876 pounds.

Specimens of the present configuration of the invention, using the bracket 40, have been installed, loaded, and tested for required removal (upward) force. The removal force varies as a function of the previously applied load force, and, over a wide intermediate range of loading, the removal force is in the range of two-thirds of the load force. These removal readings ran as high as 8,000 pounds when the loading force was 12,000 pounds. Removal of columns 20 installed by medium hammer blows alone, without bracket 40 or loading of the column 20, gave removal readings of 3,000 pounds and up, which indicates that in any case this system, as described, provides more than adequate resistance to overturning wind forces upon the structure.

Less lateral bending moment is required of the shorter columns 21, and these are therefore fabricated from 2"×2"×3/16" tubing, up to 20" support height, or 23" overall. FIGS. 13 and 14 are two views which show a smaller, short column 21 being inserted into deep socket 11, when the underframe 3 is in place and close to the ground surface 2 and the socket 11. This column 21 requires a different wedge 31, which is wider than wedge 30 by enough to match the difference in width of columns 20 and 21, which is in this case one inch. The use of the same width deep socket 11 to accommodate the two sizes of the columns 20 and 21 is desirable for several reasons. It simplifies manufacture, and it reduces the stock of the supplier and the installer. Also, the installer, when installing the sockets 11 before the unit 4 is in place, will in some instances not know what length column 20 or 21 will fit, and therefore which size column 20 or 21 will be used. The most compelling reason, however, for using the same socket for the smaller column 21, is that the extra clearance is required for insertion of the column 21, when the frame member 3 is within a few inches of the socket 11, as in FIGS. 13 and 14.

The 2"×2" column 21 requires only approximately 3 inches as a minimum length for its surface which contacts the wedge 31, so that using socket 11, an adjustment of 5" is provided for this smaller column 21. The column 21 as shown in FIGS. 13 and 14 depicts its use with a minimum height for frame 3, of 5". This particular column 21 is adjusted upward 5" to accommodate any frame 3 support height up to 10". This smaller column 21 is furnished in two additional sizes, to cover frame 3 support heights to a maximum of 20". Above 20", the columns 20 are the 3"×2" size, and are furnished in 4" size increments. The maximum frame 3 support height for each of these sizes is 24", 28", 32", etc.

Under this dual size use of socket 11, there is no problem in insertion of the larger 2"×3" column 20, since the minimum frame support height for its use is 20". This dual use of the socket 11 is advantageous in that the installer does not have to pre-calculate the column 20, 21 length. Also, a minimum number of sizes of columns 20,21 need to be stocked for installation (six sizes cover the height range from 5" to 32"), and use of the 2"×2" material for the shorter sizes saves on material and handling costs. The 2"×3" stock and the 2"×2" stock is well within its rated capacity for lateral loading in the sizes as outlined, without diagonal bracing. It should be noted that the structural tubing utilized for the columns, 20 and 21, is available in many wall thicknesses, and adjustments in strength of a particular column 20, 21 can easily be made by using material with a different wall thickness.

Figure 15:
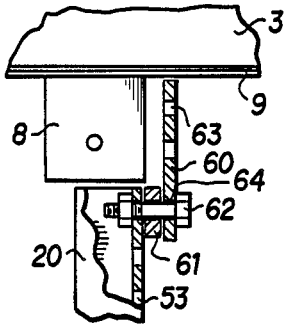
FIG. 15 is a side view in partial section of the bracket and spacer installed to provide support at the location of a spring hanger.
Figure 16:
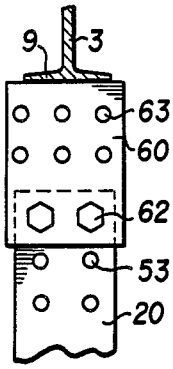
FIG. 16 is a front view of the bracket, showing the pattern of the holes provided for attachment to the underframe.

FIGS. 15 and 16 show a side view and plan view of bracket 60, which is bolted to the top of the column 20, in those few instances in which a spring hanger 8 is located at the exact spot along the frame 3 to which the column 20 must attach. Bracket 60 is attached to column 20 by means of bolts 62 which pass through two holes 64 in the lower portion of bracket 60 and the two uppermost holes 53 in column 20. Spacers 61 are used to move the bracket 60 to one side if they are necessary to clear spring hanger 8 (see FIG. 13). This happens only when column 20, which is 2" wide, is positioned almost exactly in the middle of spring hanger 8, which in most cases is 3" wide. Bracket 60 has its own pattern of holes 63, to which bolts 51 are affixed to secure bracket 60 to the underframe 3. Bracket 60 is manufactured from sheet or strip steel, with punched holes 63 of the proper size.

Figure 8:
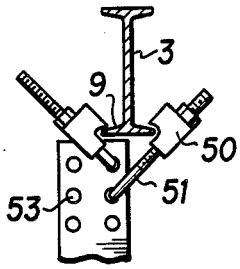
Figure 17:
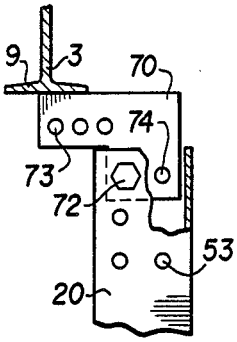
FIG. 17 shows an alternate bracket which allows a greater lateral misalignment.

FIG. 17 shows an L-shaped bracket 70, which attaches to the top of column 20 for use in instances in which a socket 11 is installed out of line, resulting in misalignment of the column 20 and frame 3, in an amount too large to be compensated for by the column 20 alone, as shown in FIG. 8. Bracket 70 has a portion which extends into the open end of column 20, and holes 74 in this portion are lined up with the two top holes 53 of the column 20, and secured with two bolts 72. Bracket 70 is also fabricated from steel strip or plate, in a press-type operation. Both bracket 60 and bracket 70 are supplied in a separate size to fit column 21 also.

Holes 43 in column 20 must always be to the outside of the underframed unit 4 to facilitate access to the wedge 20 and bracket 40. A simple manufacturing process is used which entails the reversing of every second column at the manufacturing station where holes 53 are drilled. The installer will then have on hand right-hand and left-hand columns, and he can choose the proper one for the few situations in which bracket 60 must be used on a particular side of column 20. This process makes it unnecessary to drill holes 53 on both sides of columns 20.

FIG. 18 depicts a manufactured unit 4 installed on sloping ground as an example to illustrate the use of two sizes (2"×2" and 2"×3") of columns 21 and 20, and to illustrate the use of cross bracing on unusually long columns of the larger of the two sizes. Columns 21 are the smaller size, in the short lengths, and columns 20 are the larger size in intermediate lengths, 20" to 36". Columns 22 are the same larger 2"×3" size, but in lengths up to six feet. These columns 22 are braced, each from its lower end to a point on the frame 3 adjacent the upper end of the opposite column 22, as shown in FIG. 19. These columns 22 are identical to columns 20 except for the greater length of columns 22, and the fact that the columns 20 are manufactured without hole or holes 83 for the bracket 80.

Figure 21:
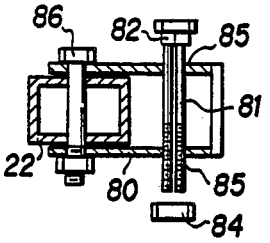
FIG. 21 is a partial section, plan view of the column and the strap-securing bracket, showing the attachment bolt and the split tightening bolt.
Figure 22:
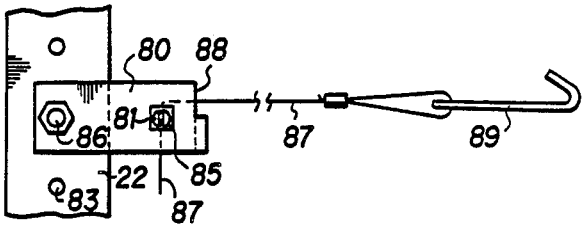
FIG. 22 is a side view of the column and bracket, showing the strap threaded through the split tightening bolt.

Bracket 80, shown in detail in FIGS. 21 and 22, is secured by bolt 86 to one of holes 83 in the lower portion of column 22, close to socket 11. Strap 87 is affixed to the opposite frame member 3 by means of its end hook 89, and its opposite end is laced through split bolt 81, which is retained by square holes 85 in bracket 80. Bolts 86 are tightened only slightly on each pair of brackets 80, to allow brackets 80 to align themselves when straps 87 are tightened. One strap is tightened only a medium amount by turning split bolt 81, so as to take up all slack without causing more than a very slight horizontal movement of frame 3 and the top end of opposite column 22, and is secured by tightening nut 84 which pulls and secures square shoulder 82 on split bolt 81, into square hole 85. The opposite strap 87 is installed and tightened securely by turning its split bolt 81, which is then locked by tightening its nut 84, pulling its square shoulder 82 into square hole 85. Both bolts 86 are then tightened securely.

In view of the capacity of straps 87, which is 5,000 pounds, and in view of the large excess vertical load capacity of the columns 22 and lower end vertical support, this system is extremely secure. It has the capacity in most special applications to support a column 22 length of six feet or more, when only a portion of the columns 20, 22 under an underframed unit are extra long.

FIG. 20 shows the frame 3 of a unit 4, in an end view, and the columns 20, 21, or 22 in contact with a location on frame 3. Over-the-top strap 5 is shown as it is installed at the factory, under the outer covering 6 of unit 4. Its free end is angled to the lower portion of the column 20, 21, or 22, to which it is attached by means of bracket 80, which is secured to the column 20, 21, 22 at one of holes 83.

Figure 23:
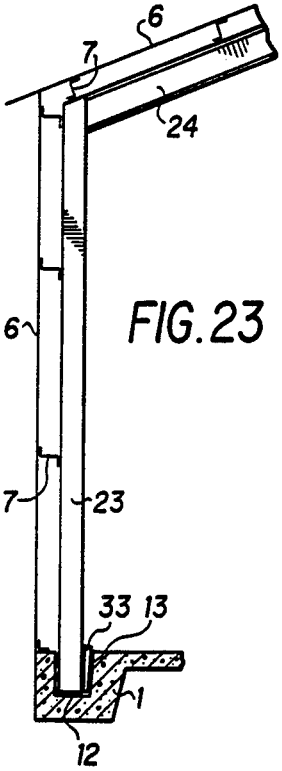
FIG. 23 is a partial side view of a column-truss combination secured in a socket within a conventional concrete slab.

FIG. 23 depicts a generally larger size square or rectangular structural tubing member which comprises column 23, which is part of a prefabricated column 23 and roof truss 24 unit. This embodiment is adapted for use in prefabricated metal buildings, in which roof and wall purlins 7 sometimes support the exterior covering 6 of the building. Socket 12 is secured in the proper location before the reinforced floor slab 1 is poured, and is shown here as a non-height-adjustable socket 12 and column 23 combination, which is the type most commonly used when a concrete floor slab 1 comprises the concrete member which secures the socket 12. However, socket 12 is also furnished as a deep socket, for column 23 height adjustment. When socket 12 is not installed in a location in the floor slab 1 which already has a beam or pier which will adequately surround the socket 12, a special spot enlargement of the concrete 1 is provided, generally as shown in FIG. 21.

These larger columns 23 support more weight, and resist larger lateral and uplift forces, primarily because they are spaced farther apart, support a portion of a larger span between rows of columns 23, and are much longer. In most instances, the required size and strength of the column 23 is determined by the calculated horizontal (wind) loading, which was the case also with the smaller sockets 10, 11 and column 20, 21 arrangements discussed in detail earlier. There are many situations, as for instance a very long building, in which each column 23 must support its share of the wind load, unaided by bracing furnished by end or cross partitions walls. In cases such as that depicted in FIG. 23, in which roof member 24 is a beam type member which is joined securely to column 23, the strength requirement of column 23 is somewhat reduced, for a given lateral load.

In the great majority of cases a particular size of rectangular structural tubing comprising column 23 which answers the particular lateral loading requirements, will be understressed in regard to vertical loading in either direction. In order to adequately secure the lower end of column 23, socket 12 is sized to accommodate the larger column 23 and a matching larger wedge 33 in the horizontal directions, and its depth is such that wedge 33 contacts column 23 for a distance which is somewhat greater than the larger horizontal dimension of column 23. Socket 12 is furnished also with rounded vertical corners 16 opposite the slanted side 13 and wedge 33, similar to the earlier illustration shown in FIG. 5.

Socket 12 is constructed from a lightweight and inexpensive sheet material which is easily formed. The only requirement of socket 12 in regard to strength and rigidity is that it withstand shipping, handling, and installation without suffering any deformity. Socket 12, like sockets 10 and 11 discussed previously, has no features which are designed to anchor it in the concrete 1. After installation, its vertical location in the concrete socket that surrounds it and was formed by it, is maintained primarily by friction between the metal socket 12 and the concrete 1. This friction, along with the friction which secures the column 23 from vertical movement with respect to the metal socket 12, is created by the substantial horizontal pressure which is applied by the two divergent surfaces of the driven wedge 33.

This pressure is contained by the slanted surface of the concrete 1 socket and its opposite vertical concrete 1 surface, and passes through the two metal socket 12 sidewalls which contact these two concrete 1 surfaces, and passes through the wedge 33 and the column 23. The friction which maintains the vertical position of the socket 12 and column 23, then, operates upon a total of ten surfaces, as there are two affected surfaces each on the concrete 1, the wedge 33, the column 23, and on each of *two* sidewalls of the metal socket 12.

Figure 24:
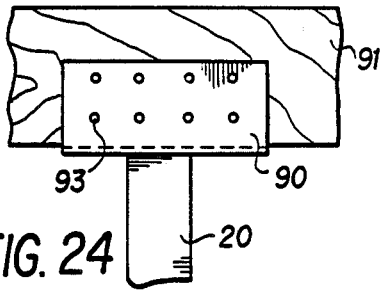
FIG. 24 is a front view of an apparatus on the upper end of the column which supports and is attached to a wood beam arrangement.
Figure 25:
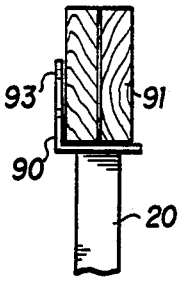
FIG. 25 is a side view of FIG. 24.

FIGS. 24 and 25 show another embodiment of means to connect the top end of columns 20, 21, or 22 to a structure, in this case a site-built structure using wooden beams 91 as the floor support. The columns 20, 21, or 22 are placed at any points desired for support, including the outside perimeter of the structure. The simplest method of installation is the previously mentioned layout of piers 1 or beams 1 at grade level 2, FIGS. 18, 19, and 20, with individual sockets 11 positioned in the proper locations. After the concrete 1 cures, a string is stretched along each line of column 11 locations at the elevation of the bottom of beam 91, FIGS. 24 and 25. Each column 11 in that line is then positioned by driving its wedge 30 with one hand while the column 11 is supported with its top at the string height, with the other hand. This system eliminates any necessity for concrete 1 forming in nearly all instances, and any building site that is not extremely unlevel can be built upon without any site preparation. Bracket 90 is an L-shaped piece of medium weight sheet metal, and has several holes 93, which are positioned to receive nails driven into beam 91 to secure it. Bracket 90 is welded to column 20.

What is claimed is:

1. A foundation apparatus which joins to a concrete foundation member at its lower portion and supports a segment of a structure at its upper end, said apparatus comprising:

A. a lightweight, thin, metal socket member embedded in and reinforced by a concrete member;

B. said socket having a portion with vertical walls for receiving a vertical column member;

C. an adjoining portion of said socket with a vertically divergent wall section which receives a vertically divergent wedge member;

D. said wedge member capable of being driven into forceable contact with said socket on its one side and said column on it other, opposite, side;

E. said wedge, once driven, securing said column from movement in respect to said socket;

F. said column supporting a structure segment at its upper end;

G. said socket extending downwardly substantially beyond the lower end of said wedge when installed;

H. an adjustable length tension member connecting an aperture in the upper end of said locking member to one of a plurality of apertues located in a vertical line in the surface of said column adjacent said wedge; and I. said tension member acting in a direction and a manner to cause said wedge to move downward in tandem with said column when said column is forced downward a minute distance by a vertical overload.

2. The foundation of claim 1, wherein said locking member further comprises:

(A) a vertically aligned channel shape;

(B) said channel shape having its lower end open and its upper end comprising an overlapping flap having an aperture for receiving said tension member;

(C) said tension member comprised of a threaded bolt with its lower end formed into a shape to interact with one of said apertues in said column; and (D) tension force such that the upper end of said locking member is urged toward, and engages, said column.

3. A foundation method for formation and utilization of a void within a concrete foundation member for support of a segment of a structure, comprising the steps of:

(A) fabrication of a metal socket means having a predetermined size and shape;

(B) placement of the said metal socket means in a concrete foundation member at the time of placement of said concrete member as a slurry;

(C) allowing the curing of said concrete member, during which curing an unspecified amount of time must pass;

(D) placement of a vertical column member within said metal socket means;

(E) placement of a wedge adjacent said column within said metal socket means;

(F) forcible driving of said wedge into said metal socket means; and (G) attaching a securement bracket to said column, with its lower end in intimate contact with the upper end of said wedge.

4. A foundation apparatus which joins to a concrete foundation member at its lower portion and supports and secures a segment of a structure at is upper end, said apparatus comprising:

(A) a thin, deformable, metal socket means embedded in and reinforced by said concrete member, said socket having vertical side and rear walls and an upwardly divergent front wall;

(B) a column, fabricated from rectangular tubing, installed vertically in said socket means, its lower portion positioned adjacent said rear and side walls of said socket means;

(C) a wedge driven between the front surface of said column and said divergent front wall of said socket means;

(D) a locking mechanism, operably attached between said column and said wedge in a manner to cause said wedge to move downward in tandem with said column;

(E) support and securement means at said column's upper end, which support and securement means supports a segment of a structure and secures said segment against upward, downward and lateral movement with respect to said column;

(F) said side walls of the socket spaced to provide a clearance between each said side wall and the adjacent surface of said column;

(G) said rear wall of said socket means, which bears against the rear surface of said column, characterized as concave in a side-to-side direction so that said column, when installed in said socket, is secured by surface contact between said column's front surface and a surface of said wedge, and by vertical line contact between each of said column's rear corners and said concave surface of said rear socket wall; and (H) said surface contact and said line contact creating horizontally triangulated securement of said column along a portion of its length, preventing movement of its free end in any lateral direction so that said column is prevented from upward and from downward movement, its vertical location maintained by friction resulting from the horizontal pressure created by said wedge and bearing upon vertically regular and continuous surfaces of said column.

5. The apparatus of claim 4, in which said socket means extends downwardly substantially below the lower end of said wedge, when installed, making possible the installation of said column at any vertical location within a predetermined range of vertical locations and said column's securement solely by pressure from said wedge acting against said vertically regular and continuous surfaces of said column.

6. The apparatus of claim 5, in which said column is furnished as a series of columns having multiple lengths, wherein the difference in the length of successive columns in a series is equal to a range of height adjustment of an individual column made possible by said downward socket extension, so that routine, level installation of a structure at a location characterized by unlevel terrain is accommodated by said socket means installed at ground level at individual locations which may vary significantly in elevation.

7. The apparatus of claim 6, in which said series of column lengths accommodates a total variation of more than three feet in the distance from said individual socket means to a corresponding individual support point on said structure.

8. The foundation apparatus of claim 4, in which said socket means is fabricated from sheet material, the thickness of which is a fraction of the thickness of said column, and said socket means, by reason of its thinness, is rendered incapable, in an unsupported state, of containing horizontal forces generated by said wedge.

9. The foundation apparatus of claim 4, in which said column is fabricated from standard specification structural rectangular tubing wherein said tubing dimensions vary within specified tolerance limits said tubing has rounded corners, the radius of which may individually vary within specified tolerance limits, and in which the distance between sidewalls of said socket means is characterized as the sum of the higher limit of column width plus an additional amount for clearance; said additional clearance amount predetermined to compensate for an off-center location of said column within said socket means due to the largest specified variation between the individual radii of said curved surfaces of said two rear corners of said column.

10. The foundation apparatus in claim 9, in which said clearance is increased a predetermined amount to accommodate a specified minor deviation from squareness of mating surfaces of said column and said wedge.

11. The foundation apparatus in claim 9, in which said line contact between said column's rear corners and said rear socket wall is positioned within said curved section of said respective rear corners of said column.

12. The foundation apparatus of claim 4, in which said wedge has a cross section approximating a channel shape with rounded corners with a solid side bearing against said column and open edges bearing against said socket means' divergent wall, wherein the front-to-back dimension of said wedge is characterized as relatively large, resulting in a relatively large front-to-back dimension of said socket means which accommodates insertion of said column into the front side of said socket means at an angle, to be then rotated to vertical and positioned under said frame member, said frame member having been pre-positioned directly above and relatively close to said socket means.

13. The apparatus of claim 12, wherein said front-to-back dimension of said wedge is approximately equal to the front-to-back dimensions of said column.

14. The apparatus of claim 12, wherein the thickness, and therefore the strength, of the material of said wedge, is such that hard driving of said wedge causes a slight deformation of said rounded corners of said wedge.

15. The apparatus of claim 4, in which a single size of said socket means is used to alternatively accommodate:

(A) a first column and first wedge, and (B) a second column having a larger front-to-back dimension, in conjunction with a second wedge having a smaller front-to-back dimension.

16. The apparatus of claim 4, in which said locking mechanism comprises a vertically disposed, elongated compression member of approximately channel shape, its open side positioned flat against the front face of said column, its lower end bearing against the upper edge of said wedge, and its top end closed and having an orifice to receive a tension member comprising a threaded bolt, its lower end shaped to operably engage one of a vertically aligned series of holes in the front wall of said column.

17. The apparatus of claim 4, in which said structure has a longitudinal support member consisting of a steel I-beam wherein said support and securement means comprises:

(A) a vertically disposed, approximately rectangular plate means, its lower portion welded to one side of the upper end of the rectangular tubing portion of said column, its upper edge positioned horizontally and supporting said I-beam; and (B) a pair of biased tension members, each operably connected between a respective side of the flange of said I-beam and one of a plurality of holes positioned within said plate means.

18. The apparatus of claim 17, in which said plate means extends substantially above said upper end of said rectangular portion of said column, accommodating installation of said column, including said securement means, at a location wherein said tubing portion of said column lies directly beneath an obstruction such as a spring hanger, so that said plate means contacts said I-beam at a location immediately adjacent said obstruction.

19. The apparatus in claim 18, in which said column has said support plate means positioned on alternate sides of said successive columns, further facilitating installation of said column in the immediate vicinity of said obstructions on the lower surface of said I-beam.

20. The apparatus in claim 17, in which said plate means is horizontally elongated, and said plurality of holes are positioned, in part, along a horizontal line in the mid-portion of said plate means, thereby accommodating support and securement of said I-beam upon the top edge of said plate means, at any lateral location which lies within a predetermined range of lateral locations.

21. The apparatus in claim 17, in which each of said tension members comprises a bolt member and a bracket member wherein:

(A) said bolt member has a first end with two sharp bends of less than 90 degrees adjacent each other in reverse direction, said first end disposed for tensional engagement with one of said plurality of holes in said plate means;

(B) said bolt member has a second end having a relatively long threaded section suited to adjustable tensile connection with said bracket member;

(C) said bracket member having a form approximating an elongated deep and narrow channel, its open side disposed toward said I-beam, and said bracket having a rectangular overall shape with one corner of said open side removed to form a remaining shoulder suited to downward abuttment against said I-beam; and (D) said bolt cradled in the bottom of said narrow channel and adjacent the edge of said I-beam, with its tensile force applied to the uppermost end of said narrow channel of said bracket, to be passed through a shoulder portion of said bracket as a compression force, thereby securing said I-beam to the edge of said plate means in a biased manner.

* * * * *